US010099708B2

(12) United States Patent
Krueger

(10) Patent No.: US 10,099,708 B2
(45) Date of Patent: Oct. 16, 2018

(54) HEIGHT-ADJUSTABLE STEP PLATFORM FOR A RAIL VEHICLE

(71) Applicant: SIEMENS AKTIENGESELLSCHAFT, Munich (DE)

(72) Inventor: Axel Krueger, Krefeld (DE)

(73) Assignee: Siemens Aktiengesellschaft, Munich (DE)

( * ) Notice: Subject to any disclaimer, the term of this patent is extended or adjusted under 35 U.S.C. 154(b) by 86 days.

(21) Appl. No.: 15/300,383

(22) PCT Filed: Mar. 19, 2015

(86) PCT No.: PCT/EP2015/055791
§ 371 (c)(1),
(2) Date: Sep. 29, 2016

(87) PCT Pub. No.: WO2015/150094
PCT Pub. Date: Oct. 8, 2015

(65) Prior Publication Data

US 2017/0137038 A1 May 18, 2017

(30) Foreign Application Priority Data

Apr. 1, 2014 (DE) ..... 10 2014 206 184

(51) Int. Cl.
*B61D 23/02* (2006.01)

(52) U.S. Cl.
CPC ..... *B61D 23/02* (2013.01)

(58) Field of Classification Search
CPC ..... B61D 23/00; B61D 23/02; B61D 23/025
See application file for complete search history.

(56) References Cited

U.S. PATENT DOCUMENTS 5,775,232 A * 7/1998 Golemis ..... B61D 23/025 105/458
6,167,816 B1 * 1/2001 Lavery ..... B61D 23/025 105/458
6,186,733 B1 * 2/2001 Lewis ..... A61G 3/061 414/537

(Continued)

FOREIGN PATENT DOCUMENTS

DE 3812564 A1 11/1989
DE 29706590 U1 9/1998

(Continued)

OTHER PUBLICATIONS

MBB Palfinger GmbH; "MBB MEDILIFT R3.3"; www.palfinger.com; Aug. 8, 2012. Fockestr. 5327777 Ganderkesee/Hoykenkamp.

*Primary Examiner* — Jason C Smith
(74) *Attorney, Agent, or Firm* — Laurence Greenberg; Werner Stemer; Ralph Locher

(57) ABSTRACT

A passenger rail vehicle includes at least one linearly movable step platform which is disposed in a boarding region of the rail vehicle and is used to bridge a gap in the horizontal direction between the boarding region of the rail vehicle and a station platform. The step platform includes a front section which forms part of a step surface of the step platform. The front section is mounted about a horizontal axis so that it can pivot on the step platform to form a ramp between a remaining step surface of the step platform and the station platform.

5 Claims, 1 Drawing Sheet

(56) References Cited

U.S. PATENT DOCUMENTS

| | | | | |
|---|---|---|---|---|
| 7,178,467 | B2 * | 2/2007 | Le Bellec | B61D 23/02 105/458 |
| 7,802,337 | B2 * | 9/2010 | van Roosmalen | A61G 3/061 105/425 |
| 8,020,496 | B1 * | 9/2011 | Maysonet | B61B 1/00 105/425 |
| 8,556,283 | B2 * | 10/2013 | Coochesfahani | B61D 23/025 105/447 |
| 9,505,330 | B2 * | 11/2016 | Hirtenlehner | B61D 23/025 |
| 9,598,090 | B1 * | 3/2017 | Maysonet | B61B 1/02 |
| 2008/0276832 | A1 * | 11/2008 | Chisena | B61D 23/025 105/458 |
| 2017/0044819 | A1 * | 2/2017 | Krueger | B61D 19/02 |
| 2017/0137038 | A1 * | 5/2017 | Krueger | B61D 23/02 |

FOREIGN PATENT DOCUMENTS

| | | | |
|---|---|---|---|
| DE | 29902687 | U1 | 5/1999 |
| DE | 20319248 | U1 | 3/2004 |
| DE | 102005057901 | A1 | 6/2007 |
| DE | 202010000524 | U1 | 4/2011 |
| DE | 102010022407 | A1 | 12/2011 |
| DE | 202011106862 | U1 | 1/2012 |
| EP | 1078813 | A2 | 2/2001 |
| EP | 2401994 | A2 | 1/2012 |
| EP | 2597007 | A1 | 5/2013 |
| FR | 2873635 | A1 | 2/2006 |
| GB | 2369344 | A | 5/2002 |
| WO | 2012035261 | A1 | 3/2012 |

* cited by examiner

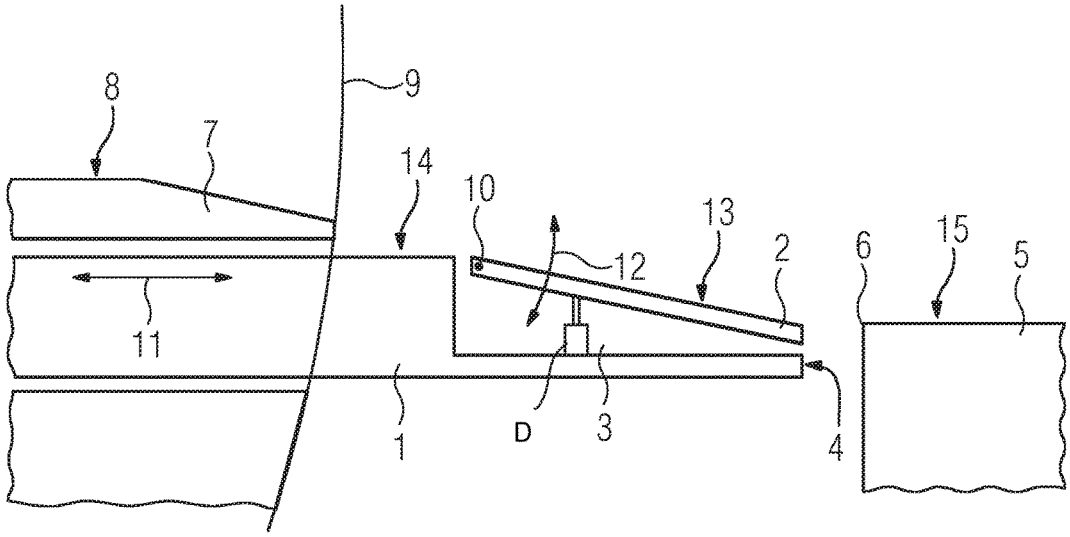
8
7
9
14
10
12
13
2
6
15
5
11
1
D
3
4

HEIGHT-ADJUSTABLE STEP PLATFORM FOR A RAIL VEHICLE

BACKGROUND OF THE INVENTION

Field of the Invention

The invention relates to a rail vehicle for passenger transport, having a linearly displaceable step platform which is arranged in a boarding region of the rail vehicle and which serves for bridging a gap in a horizontal direction between the boarding region of the rail vehicle and a station platform.

Step platforms of said type are known to a person skilled in the art for example from DE 20 2010 000 524 U1, wherein here, a further step is mounted pivotably on the horizontally displaceable step platform in order, when there is an excessively large height difference between a floor level of the boarding region of the rail vehicle and a station platform level, to facilitate boarding or disembarking by way of an intermediate step. However, such access is not adapted to the needs of the disabled.

If step platforms are displaceable only linearly, normally in a horizontal direction, they are sometimes also referred to as sliding steps. A disadvantage here is that, in the production of rail vehicles, component tolerances arise, such that the actual height of the step surface of a sliding step can deviate considerably from the predefined nominal dimension. This is of significance in particular if compliance with legal, normative or contractual specifications is demanded, such as for example compliance with a maximum admissible height difference between the step surface of the sliding step and the station platform surface. In addition to component tolerances, it is the case both during operation and during the maintenance of the rail vehicle that events occur which influence the magnitude of said height difference, such as for example wheel tire wear, settling effects of spring elements or over speeding of wheel tires. A height adaptation of the sliding steps to the station platform level may be realized by raising or lowering the vehicle, for example by way of shims under the secondary springs or by way of follow-up regulation of the pneumatic suspension arrangement, which is highly cumbersome.

Further step platforms that are also height-adjustable in a vertical direction for the purposes of being able to serve different station platform heights have become known for example from DE 38 12 564 A1, DE 10 2005 057 901 A1, DE 10 2010 022 407 A1 or FR 2 873 635 A1. Here, in each case, the entire construction is designed to be movable in terms of height for the purposes of adaptation of the floor level of the boarding region of the rail vehicle and of the station platform level.

BRIEF SUMMARY OF THE INVENTION

The invention is based on the object of adapting each individual step platform of a rail vehicle easily and quickly to the station platform level.

The object is achieved by way of the subject matter recited below. Refinements and embodiments of the invention can be found in the features recited below as well.

A rail vehicle according to the invention for passenger transport comprises at least one linearly displaceable step platform which is arranged in a boarding region of the rail vehicle and which serves for bridging a gap in a horizontal direction between the boarding region of the rail vehicle and a station platform, characterized in that the step platform comprises a front section which forms part of a step surface of the step platform, which front section is mounted on the step platform so as to be pivotable about a horizontal axis in order to form a ramp between the remaining step surface of the step platform and the station platform.

The front section of the step platform thus serves for bridging a height difference between the remaining step surface of the step platform and the station platform surface. The height difference between the remaining step surface of the step platform and the station platform surface may also be referred to as the gap in a vertical direction.

The step platform thus has a step surface for being walked on by passengers, which step surface is divided into at least two parts. The front section forms the first part. The latter is, in a fully extended state of the step platform, spaced apart from the boarding region of the rail vehicle and arranged on that side of the step platform which is averted from the rail vehicle. In the fully extended state of the step platform, the remaining, second part of the step surface of the step platform faces toward the rail vehicle and is thus arranged in a horizontal direction between the first part of the step surface of the front section and the boarding region of the rail vehicle.

The remaining, second part of the step surface is displaceable along a predefined plane relative to the rail vehicle. Said remaining, second part of the step surface is adjoined, in particular directly, by the front section and thus by the first part of the step surface, which is formed by the front section. The first part of the step surface of the front section may in this case run parallel to the remaining, second step surface, such that the step platform forms a planar step surface. It is however also possible, in order to facilitate boarding and/or disembarking, for the front section to be pivoted or inclined about the axis, and thus to form a ramp between the remaining step surface of the step platform and the station platform.

In one refinement of the invention, the step platform is linearly displaceable in a horizontal direction. Said horizontal displacement takes place in particular along an axis perpendicular to a longitudinal axis of the rail vehicle. Here, the entire step platform including the front section is displaced relative to the rail vehicle. An embodiment of the solution according to the invention provides for the remaining, second part of the step surface to be displaceable exclusively along a predefined plane, in particular horizontally relative to the rail vehicle.

A further refinement can be seen in the fact that the horizontal axis, rotatably about which the front section of the step platform is mounted on the step platform, runs parallel to a longitudinal axis of the rail vehicle. When the rail vehicle is at a standstill at a station platform, the longitudinal axis of the rail vehicle normally runs in the direction of travel of the rail vehicle and also parallel to the profile of an edge of the station platform.

In one embodiment of the invention, the remaining, second part of the step platform in the region of the boarding region of the rail vehicle substantially reaches to the floor level in the boarding region of the rail vehicle. For example, the remaining, second part of the step platform adjoins a door sill of the boarding region and thus substantially reaches to the floor level. The front section of the step platform thus forms a ramp between the station platform level and the floor level of the boarding region of the rail vehicle.

In a refinement, the rail vehicle comprises a drive, for example an electric, hydraulic or pneumatic drive, for adjusting an angle of inclination of the front section, which is mounted so as to be rotatable about a horizontal axis, of the step platform.

A further exemplary embodiment provides that the step platform has, in the region of the front section, a step-shaped recess for receiving the front section of the step platform. In the extended state of the step platform, the step-shaped recess is arranged on a side which is averted from the boarding region of the rail vehicle and which faces toward the station platform, in particular in the region of a front end, which is averted from the rail vehicle and which faces toward the station platform, of the step platform. That front end of the step platform which is averted from the rail vehicle delimits the step platform in particular in a horizontal direction at said side. Said front end may form a stop for bearing against a station platform edge, such that the step platform and thus also the first section of the step platform do not lie on the station platform but rather abut against the station platform edge, possibly with the formation of a predefined small gap between the station platform edge and the front end of the step platform. The gap has a maximum value defined by certification regulations or operator specifications.

In a refinement, the front section of the step platform is rotatably mounted in the step-shaped recess.

The length of the front section of the step platform, measured in the case of a horizontal orientation of the front section, may in this case correspond to a predefined minimum gap, in a horizontal direction, between the outer shell of the car body of the rail vehicle in the boarding region of the rail vehicle and the station platform. In this case, the step platform is then, in the extended state, retracted to such an extent that the remaining, second step surface of the step platform cannot be walked on.

A gap in a vertical direction between the front edge, facing toward the station platform, of the first step surface of the front section of the step platform and the station platform surface amounts to at most 20 mm, in particular at most 15.8 mm. The maximum angle of inclination of the front section of the step platform amounts to at most 25%, in particular at most 18%.

The rail vehicle according to the invention is in particular a mainline train.

BRIEF DESCRIPTION OF THE DRAWING

The invention permits numerous embodiments. It will be discussed in more detail on the basis of the following figures, which each illustrate an exemplary embodiment. Identical elements in the figures are denoted by the same reference designations.

DESCRIPTION OF THE INVENTION

The FIGURE illustrates a rail vehicle for passenger transport, having a step platform 1 which is linearly displaceable for the purposes of bridging a gap in a horizontal direction between a boarding region 7 of the rail vehicle and a station platform 5. The linear displaceability is indicated by the double arrow 11. The step platform 1 is in this case arranged on the rail vehicle in the region of the boarding region 7 of the rail vehicle and so as to be horizontally displaceable relative to the rail vehicle, such that a gap in a horizontal direction between the boarding region 7 of the rail vehicle and the station platform 5 can be bridged.

Furthermore, the step platform 1 has a front section 2 which is arranged on the step platform 1 so as to be pivotable about the axis 10. The direction of the pivotability of the front section 2 of the step platform 1 relative to the remaining step platform 1 is indicated by the double arrow 12.

By way of the front section 2, which is adjustable in terms of inclination, of the step platform 1, a spacing between a level of the remaining step surface 14 of the step platform 1 in the region of the boarding region 7 of the rail vehicle and a station platform level 15 is bridged. At the same time, in this exemplary embodiment, the boarding region 7 is of ramp-shaped form at the front end, such that it is also the case that an in any case only small vertical spacing between a floor level 8 of the boarding region 7 and the level of the remaining step surface 14 of the step platform 1 is bridged.

Here, the step platform 1 is transversely and laterally retractable into and extendable out of a receptacle in the car body of the rail vehicle, such that, in the retracted state, said step platform is retracted entirely into the rail vehicle. Said step platform is then situated within the outer shell 9 of the rail vehicle. The structure gauge of the rail vehicle is thus not influenced by the step platform 1 when the latter is in the retracted state.

In the extended state, a front end 4, averted from the rail vehicle, of the step platform 1 can abut, with the formation of a small, predefined gap, against the station platform 5. The front section 2 then substantially adjoins the station platform edge 6 vertically and horizontally. At the same time, the first part 13 of the step surface of the step platform 1, which first part is formed by the front section, is situated, in the region facing toward the rail vehicle, at the level of the remaining step surface 14 of the step platform 1.

A simple option is, as depicted here, for the step platform 1 to comprise a recess 3 for receiving the front section 2 of the step platform 1, in which recess said front section is pivotable by a drive D relative to the remaining step platform 1 about the axis 10 for adjusting an angle of inclination of the front section 2.

The invention claimed is:

1. A rail vehicle for passenger transport, the rail vehicle comprising:

a boarding region of the rail vehicle;

at least one step platform being linearly displaceable and being disposed in said boarding region of the rail vehicle;

said at least one step platform serving to bridge a gap in a horizontal direction between said boarding region of the rail vehicle and a station platform;

said at least one step platform including a step surface, a remaining step surface and a front section forming part of said step surface;

said at least one step platform having a step-shaped recess formed in a vicinity of said front section for receiving said front section; and said front section being rotatably mounted in said step-shaped recess and being pivotably mounted on said at least one step platform about a horizontal axis to form a ramp between said remaining step surface and the station platform.

2. The rail vehicle according to claim 1, wherein said step platform is displaceable in a horizontal direction.

3. The rail vehicle according to claim 1, wherein said horizontal axis, about which said front section is rotatably mounted, runs parallel to a longitudinal axis of the rail vehicle.

4. The rail vehicle according to claim 1, which further comprises a drive for adjusting an angle of inclination of said front section.

5. The rail vehicle according to claim 1, wherein said front section has an upper surface being pivotable to a vertical height of the station platform.

* * * * *